US006281869B1

(12) United States Patent
Seino

(10) Patent No.: US 6,281,869 B1
(45) Date of Patent: Aug. 28, 2001

(54) DISPLAY DEVICE CAPABLE OF ENLARGING AND REDUCING VIDEO SIGNAL ACCORDING TO DISPLAY UNIT

(75) Inventor: Kenichi Seino, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/388,301

(22) Filed: Sep. 1, 1999

(30) Foreign Application Priority Data

Sep. 2, 1998 (JP) ..... 10-248828

(51) Int. Cl.[7] ..... G09G 3/36

(52) U.S. Cl. ..... 345/99; 345/98; 345/100; 345/127

(58) Field of Search ..... 345/98, 99, 100, 345/87, 88, 89, 95, 96, 97, 94, 211, 212, 213, 208, 127, 132

(56) References Cited

U.S. PATENT DOCUMENTS 5,801,672 9/1998 Masuda et al. .
5,864,347 1/1999 Inoue .
6,175,347 * 1/2001 Shindo et al. ..... 345/87
6,181,318 * 1/2001 Lim ..... 345/132

FOREIGN PATENT DOCUMENTS 195 40 146 A1 5/1996 (DE) .
0 725 379 A1 8/1996 (EP) .
0 730 258 A1 9/1996 (EP) .

* cited by examiner

*Primary Examiner*—Xiao Wu
(74) *Attorney, Agent, or Firm*—Brinks Hofer Gilson & Lione

(57) ABSTRACT

The display device has a driving circuit provided with a pulse generator for generating a copying clock pulse signal within one horizontal period in addition to an original clock pulse signal upon an enlargement display, a gate clock generator for generating a gate clock signal obtained by superimposing the total original clock pulse signal and the copying clock pulse signal corresponding to a number obtained by subtracting the number of vertical pixels of a video signal from the number of vertical pixels of a display unit, and a gate driver for generating a plurality of gate driving signals brought to high levels with different timings in association with respective pulses in the gate clock signal and having high level periods equal in length to one another.

6 Claims, 4 Drawing Sheets

DISPLAY DEVICE CAPABLE OF ENLARGING AND REDUCING VIDEO SIGNAL ACCORDING TO DISPLAY UNIT

BACKGROUND OF THE INVENTION

1. Field of the Invention

The present invention relates to a display device, and particularly to an image display device having the function of being capable of enlarging and reducing a video signal when the number of vertical pixels of the video signal inputted to the image display device is different from the number of vertical pixels of a display unit of the image display device.

2. Description of the Related Art

In an image display unit or device for a personal computer or the like, for example, standards are defined in the number of pixels of a display panel. A VGA standard, an SVGA standard, an XGA standard, an SXGA standard, and a UXGA standard (however, any of VGA, SVGA, XGA, SXGA and UXGA corresponds to the trademark of IBM Corporation), etc. are widely known as typical ones. However, there may be a case in which as in the case in which an image comprised of a video signal for VGA is displayed on a display panel set to the XGA standard, the number of the pixels of the video signal inputted to the device and the number of the pixels of the display panel differ from each other. In that case, it is necessary to display the video signal on the display panel in enlarged or reduced form.

There has heretofore been adopted a system for storing data lying in an area that one desires to display in enlarged form and writing the same data into a plurality of lines of the display device when it is desired to implement the display of the data in enlarged form in the vertical direction. However, the present system needs peripheral devices such as a memory, an A/D converter, etc. and hence the display device increases in size and becomes complex. Therefore, the following has been proposed as an enlargement or scale-up display method.

In this type of image display device having the scale-up display function, a mode signal indicative of either the normal display or the enlargement display is set within a gate driver. The driving of one gate line or the driving of a plurality of gate lines is switched according to the type of the mode signal within one horizontal period in which image data corresponding to one line is outputted. Thus, if the number of the gate lines driven during one horizontal period is one, then the normal display is done. When the plurality of gate lines are simultaneously driven within one horizontal period, the same image data corresponding to one line is displayed on a plurality of lines on a display screen, whereby the scale-up display in the vertical direction is done. FIG. 4 is a timing chart for describing the operation of the gate driver employed in the image display device, wherein FIG. 4A is a timing chart in a normal mode, and FIG. 4B is a timing chart at a display twice that in an enlargement mode, respectively. In FIG. 4B, gage output waveforms of adjacent two lines, which are represented as X1 and X2, and X3 and X4, are identical to each other.

On the other hand, the liquid crystal display device or the like generally makes use of a method for adding auxiliary capacitances (Cs) to respective pixels for holding electrical charges during one scanning period. Several types are considered as the structures of the auxiliary capacitances. However, as a method of avoiding a reduction in opening rate without using capacitive electrodes for constructing the auxiliary capacitances, the structure of auxiliary capacitance so-called Cs on-gate structure is provided wherein pixel electrodes and gate lines are laid out so as to overlap with each other and the auxiliary capacitances are made up of these pixel electrodes and gate lines.

It was however impossible to apply the above-described scale-up display technique to the liquid crystal display device having the auxiliary capacitances each having the Cs on-gate structure. This is because since the gate line adjacent to the gate line for driving one pixel serves as one electrode of the auxiliary capacitance for the pixel in the Cs on-gate structure, the auxiliary capacitance does not function if the gate output waveform at the adjacent gate line is not rendered low in level upon writing of data into the pixel connected to one gate line (when the gate output waveform is rendered high in level). Since, however, the above-described scale-up display method sets the gate output waveforms at the adjacent two gate lines so as to be identical to each other, each auxiliary capacitance does not function.

SUMMARY OF THE INVENTION

With the foregoing problems in view, it is therefore an object of the present invention to provide a display device having enlargement display and reduction display functions, which is capable of being applied to an image display unit such as a liquid crystal display device or the like provided with auxiliary capacitances each having a Cs on-gate structure without hindrance.

According to one aspect of the invention, for achieving the above object, there is provided a display device having an enlargement display function, comprising: a driving circuit including, pulse generating means for generating a copying second clock pulse signal within one horizontal period in addition to an original clock pulse signal generated upon provision of the number of vertical pixels identical to a predetermined number of vertical pixels of a display unit when a video signal having the number of vertical pixels smaller than the predetermined number of vertical pixels is displayed in enlarged form on the display unit to which the predetermined number of vertical pixels is set and repeating the generation of these clock pulse signals every one horizontal periods; gate clock generating means for receiving the clock pulse signal from the pulse generating means to thereby generate a gate clock signal obtained by superimposing the total original clock pulse signal and the second clock pulse signal corresponding to a number obtained by subtracting the number of the vertical pixels of the video signal from the number of the vertical pixels of the display unit; and gate driving means for receiving the gate clock signal from the gate clock generating means to thereby generate a plurality of gate driving signals which are respectively brought to high levels with different timings in association with respective pulses in the gate clock signal and have high level periods equal in length to one another.

In the driving circuit employed in the display device of the present invention, which has the scale-up display function, the pulse generating means first generates an original clock pulse signal and a copying second clock pulse signal within one horizontal period and repeats the generation of these clock pulse signals every one horizontal periods. Next, the gate clock generating means generates a gate clock signal obtained by superimposing the total original clock pulse signal and the second clock pulse signal corresponding to a number obtained by subtracting the number of vertical pixels of a video signal from the number of vertical pixels of a display unit in order to generate a gate clock signal having pulses corresponding to the number of the vertical pixels of the display unit. Then, the gate driving means is supplied with the gate clock signal generated from the gate clock generating means to thereby generate a plurality of gate driving signals respectively brought to high levels with different timings in association with the respective pulses in the gate clock signal and having high level periods equal in length to one another.

Owing to such action, a plurality of gate lines are driven within one horizontal period and the same video data corresponding to one line is displayed on a plurality of lines on the display unit. Therefore, a scale-up display corresponding to the number of the vertical pixels of the display unit is done.

Since, at this time, the plurality of gate driving signals for driving the plurality of gate lines are respectively rendered high in level with the different timings and the adjacent two gate lines are not brought to the high level perfectly simultaneously as in the case of the conventional scale-up display method, the present device can be applied even to an image display device having auxiliary capacitances each having a Cs on-gate structure. Further, since the plurality of gate driving signals respectively have high level periods equal in length to each other, no variations in image occur in the display unit.

According to another aspect of the invention, there is provided a display device having a reduction display function, comprising: a driving circuit including, pulse generating means for generating a thinning second clock pulse signal within one horizontal period, the second clock signal being identical in pulse width to an original clock pulse signal generated upon provision of the number of vertical pixels identical to a predetermined number of vertical pixels of a display unit, in addition to the original clock pulse signal when a video signal having the number of vertical pixels greater than the predetermined number of vertical pixels is displayed in reduced form on the display unit to which the predetermined number of vertical pixels is set and repeating the generation of these clock pulse signals every one horizontal periods; gate clock generating means for receiving the clock pulse signal from the pulse generating means to thereby generate a gate clock signal obtained by superimposing the total original clock pulse signal and the second clock pulse signal corresponding to a number obtained by subtracting the number of the vertical pixels of the display unit from the number of the vertical pixels of the video signal; and gate driving means for receiving the gate clock signal from the gate clock generating means to thereby generate a plurality of gate driving signals which are respectively brought to high levels with different timings in association with respective pulses in the gate clock signal and have high level periods equal in length to one another.

In the driving circuit employed in the display device of the present invention, which has the reduction display function, the pulse generating means first generates an original clock pulse signal and a thinning second clock pulse signal within one horizontal period and repeats the generation of these clock pulse signals every one horizontal periods. Next, the gate clock generating means generates a gate clock signal obtained by superimposing a total original clock pulse signal and a second clock pulse signal corresponding to a number obtained by subtracting the number of vertical pixels of a display unit from the number of vertical pixels of a video signal in order to generate a gate clock signal having pulses corresponding to the number of the vertical pixels of the display unit. Here, the term "superimposition" means that an inverter is coupled to the second clock pulse signal so as to take "NOT" and take "AND" of the result thereof and the original clock pulse signal. Thus, a gate clock signal having pulses obtained by partly thinning out the pulses of the original clock pulse signal is generated. Next, the gate driving means is supplied with the gate clock signal generated from the gate clock generating means to thereby generate a plurality of gate driving signals respectively brought to high levels with different timings in association with the respective pulses in the gate clock signal and having high level periods equal in length to one another.

Owing to such action, some of the original clock pulse signal generated when it has the same number of vertical pixels as a predetermined number of vertical pixels of the display unit is thinned as a result, whereby the reduction display corresponding to the number of the vertical pixels of the display unit is carried out.

Since, at this time, the plurality of gate driving signals for driving a plurality of gate lines are respectively brought to the high levels with the different timings, the effect that the present device can be applied even to an image display device with auxiliary capacitances each having a Cs on-gate structure without hindrance, and the effect that since the high level periods of the plurality of gate driving signals are equal in length to each other, no variations in image occur in the display unit, are similar to those obtained in the case of the enlargement or scale-up display.

Incidentally, the term "enlargement display" or "reduction display" means the enlargement or reduction related to the vertical direction and does not mean the enlargement or reduction in the horizontal direction.

In general, methods for driving the display device include line sequential driving for sequentially driving a plurality of gate lines from top to bottom and interlace driving for dividing one frame into even-numbered fields and odd-numbered fields and alternately driving gate lines while jumping in the respective fields. Further, there is known, as the line sequential driving, a method called double-speed line sequential driving for driving adjacent two gate lines within one horizontal period to thereby drive all the gate lines at twice speed. The present invention is suitable for use in a display device using double-speed line sequential driving in particular.

Namely, since the two gate lines are driven within one horizontal period in the case of the double-speed line sequential driving, the form described in the present invention that the original clock pulse signal has pulses provided by two within one horizontal period. Thus, when the reduction display is done in particular, the gate clock signal having the pulses equivalent to the number corresponding to the number of the vertical pixels of the display unit can be easily generated by thinning out some of these pulses. It is needless to say that the double-speed line sequential driving can cope with the enlargement display.

From the above point of view, the present invention can be applied not only to a TFT type liquid crystal display device but to another type of liquid crystal display device. It is considered that while, for example, the double-speed line sequential driving can be associated with an STN type liquid crystal display device, it is not suited for video representations of NTSC, PAL, etc. under the existing circumstances because the response speed of the STN type liquid crystal display device is slow as compared with a frame frequency of NTSC or PAL. It is however considered that the present invention can be applied to a ferroelectric liquid crystal device (FLCD) or anti-ferroelectric liquid crystal device (AFLCD) fast in response speed.

It is desirable that even in the case of the display device having both of the enlargement display function and the reduction display function, the gate clock generating means uniformly allocates the timings provided to superimpose the second clock pulse signal on the gate clock signal over the number of the vertical pixels of the display unit.

Owing to such a construction, an image uniform in image quality over the entire screen of the display unit can be obtained.

As described above, the display device of the present invention can be applied to the image display device with the auxiliary capacitances each having the Cs on-gate structure without any problem. Thus, when the display device of the present invention is configured as the TFT type liquid crystal display device, storage capacitances each comprised of a gate line and a pixel electrode corresponding to each pixel can be provided for the respective pixels of a display unit of the TFT type liquid crystal display device.

BRIEF DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

FIGS. 4A and 4B are diagrams for describing a conventional enlargement display method, wherein FIG. 4A is a timing chart in a normal mode and FIG. 4B is a timing chart at a display twice that in an enlargement mode.

DETAILED DESCRIPTION OF THE PREFERRED EMBODIMENT

Figure 2:
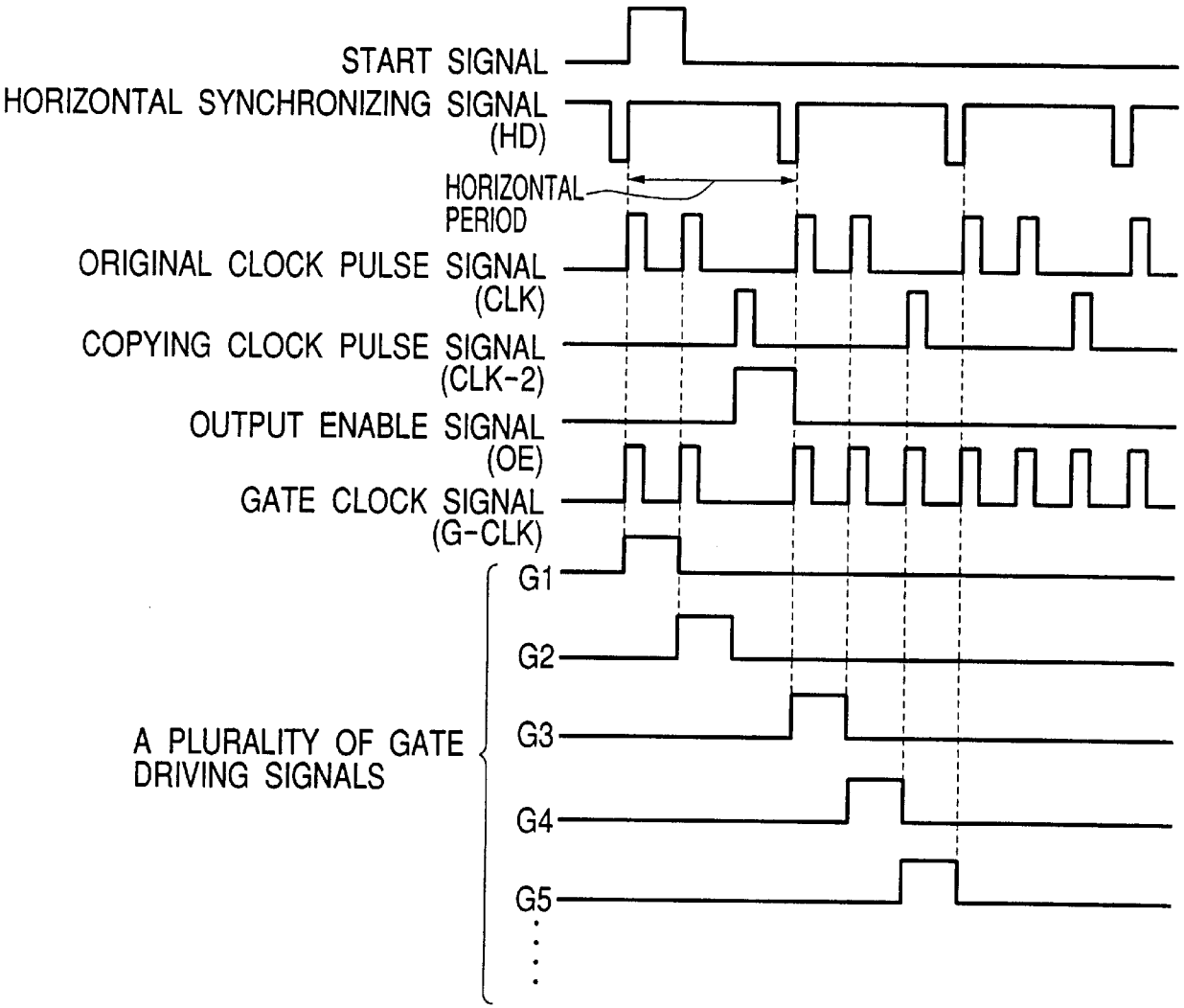
FIG. 2 is a timing chart of respective signals used to perform an enlargement display in the liquid crystal display device shown in FIG. 1.
Figure 3:
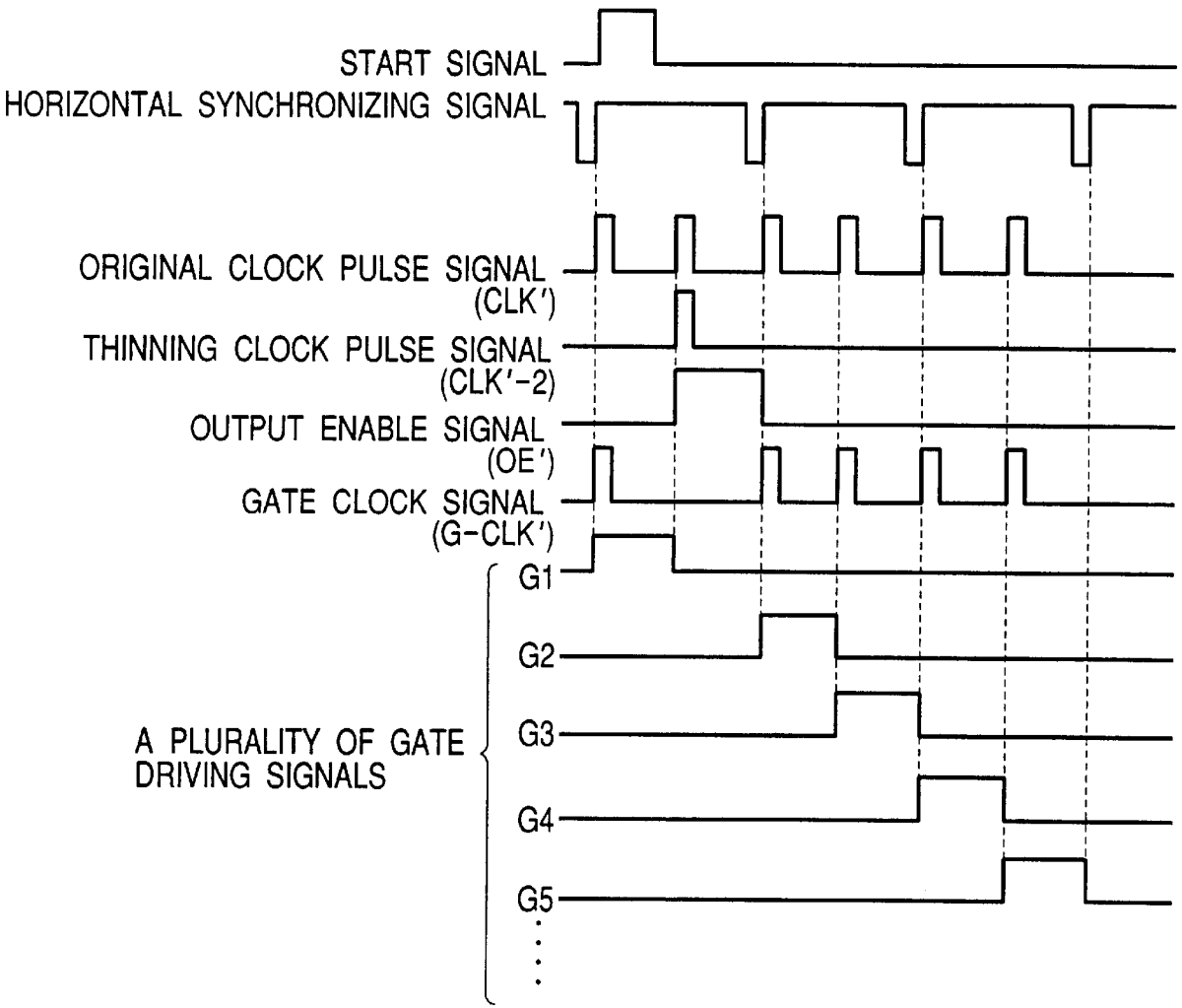
FIG. 3 is a timing chart of respective signals used to perform a reduction display in the liquid crystal display device shown in FIG. 1.
Figure 4A:
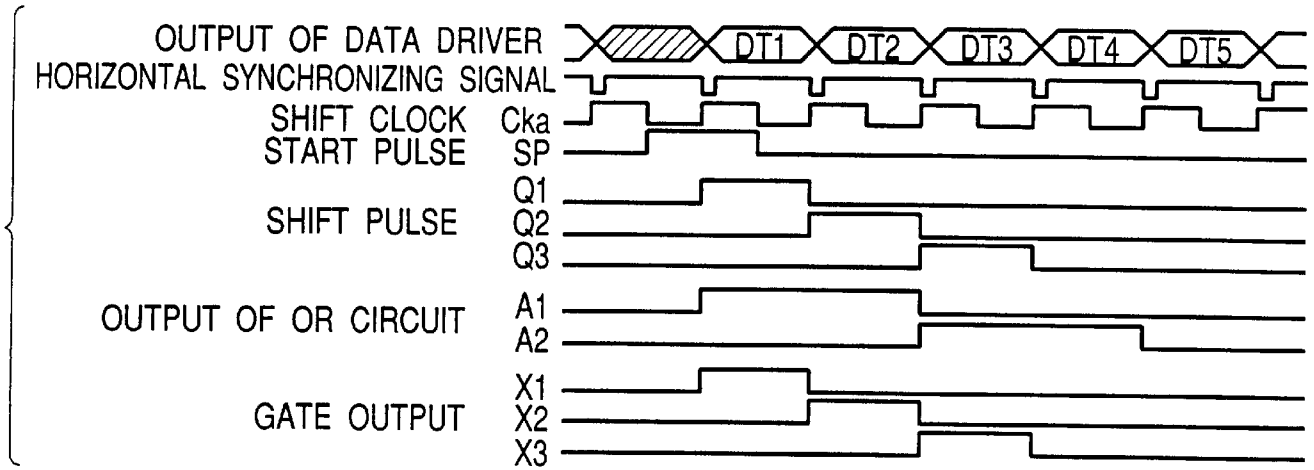
FIG. 4A PRIOR ART
Figure 4B:
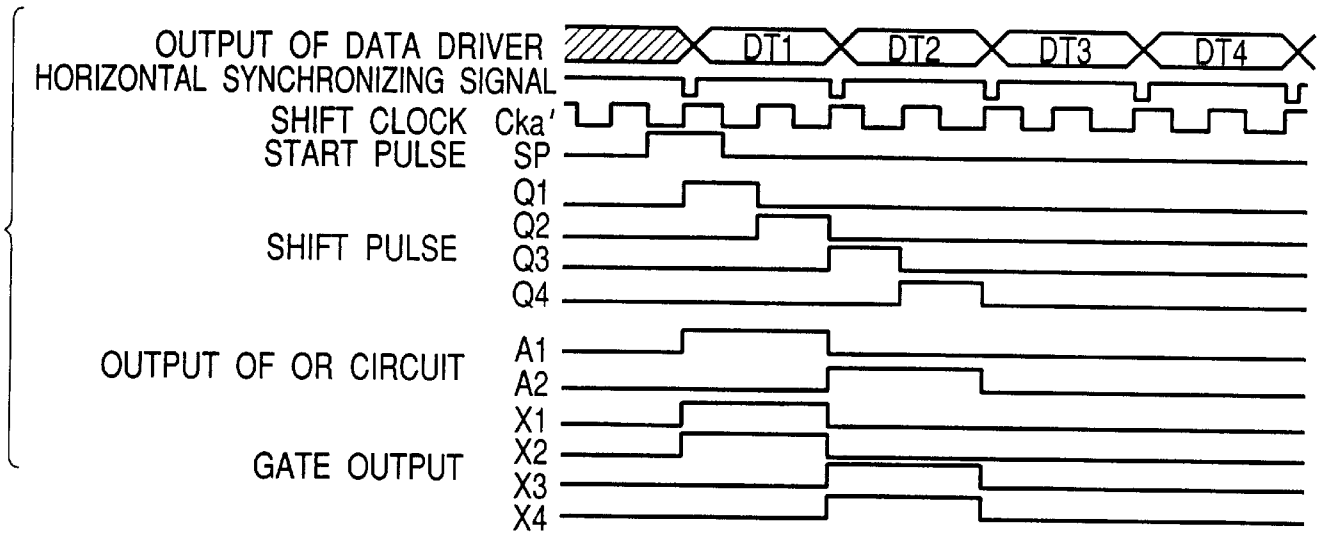
FIG. 4B PRIOR ART

A preferred embodiment of the present invention will hereinafter be described with reference to FIGS. 1 through 3.

Figure 1:
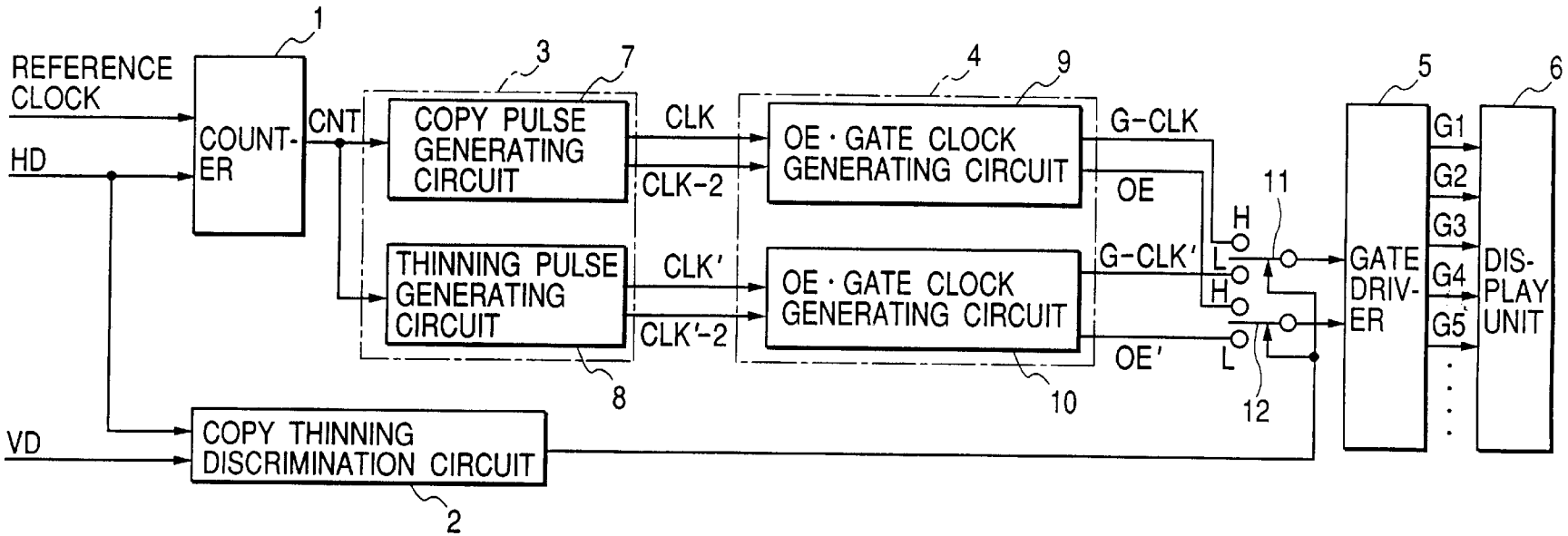
FIG. 1 is a block diagram showing a schematic configuration of a liquid crystal display device according to one embodiment of the present invention.

FIG. 1 is a block diagram schematically showing a configuration of a liquid crystal display device (display device) according to the present embodiment. The liquid crystal display device according to the present embodiment combines an enlargement display function with a reduction display function and is capable of coping with or handling both a video signal whose number of vertical pixels is smaller than the number of vertical pixels of a display part or unit and a video signal whose number of vertical pixels is greater than the number thereof.

As shown in FIG. 1, a driving circuit of the liquid crystal display device according to the present embodiment is provided with a counter 1, a copy thinning discrimination circuit 2. Further, the driving circuit is also provided with a pulse generator circuit 3 (corresponding to pulse generating means indicated by a dotted line), a gate clock generator circuit 4 (corresponding to gate clock generating means indicated by a dotted line) and a gate driver 5 (corresponding to gate driving means) respectively provided at a stage subsequent to the counter 1. The output of the driving circuit, i.e., gate driving signals G1, G2, . . . outputted from the gate driver 5 are supplied to a display unit 6. For example, a TFT-LCD panel can be used for the display unit 6. Since the liquid crystal display device according to the present embodiment combines the enlargement display function with the reduction display function, a copy pulse generating circuit 7 and a thinning pulse generating circuit 8 are provided within the pulse generator circuit 3, and output enable (hereinafter abbreviated as "OE")·gate clock generating circuits 9 and 10 respectively corresponding to the copy pulse generating circuit 7 and the thinning pulse generating circuit 8 are respectively provided within the gate clock generator circuit 4.

The copy thinning discrimination circuit 2 determines whether the number of vertical pixels of the video signal is smaller than or greater than the number of vertical pixels of the display unit 6. In order to perform switching for connection between either one of signal paths on the copy pulse generating circuit 7 side and the thinning pulse generating circuit 8 side and the gate driver 5, selector switches 11 and 12 are respectively provided between the two gate clock generating circuits 9 and 10 and the gate driver 5 respectively.

Incidentally, the term "copy" described in the present embodiment means an enlargement display operation and the term "thinning" means a reduction display operation.

The operation of the driving circuit of the liquid crystal display device having the above-described configuration will next be explained with reference to FIGS. 1 through 3. Double-speed line sequential driving will be performed by the driving circuit.

As shown in FIG. 1, a horizontal synchronizing signal (HD) and a vertical synchronizing signal (VD) are inputted to the copy thinning discrimination circuit 2 which in turn counts the number of pulses of the horizontal synchronizing signal lying during one vertical period to thereby make a decision as to a display type or mode for NTSC, PAL or the like. Further, the copy thinning discrimination circuit 2 compares the number of vertical pixels of the display unit 6 and the number of vertical pixels of the video signal and determines based on the result of comparison whether either copy or thinning should be done. When it is determined that copy is done, the copy thinning discrimination circuit 2 outputs a signal of "High" therefrom, whereas when it is determined that thinning is done, the copy thinning discrimination circuit 2 outputs a signal of "Low" therefrom. When the signal of "High" is received at the selector switches 11 and 12, the signal paths are switched to the "H" side in FIG. 1, whereas when the signal of "Low" is received at the selector switches 11 and 12, the signal paths are switched to the "L" side.

A case where the number of vertical pixels of an input video signal is smaller than the number of the vertical pixels of the display unit 6 and the copy (enlarged display) is done, will first be described below with reference to FIG. 2 by way of example.

First, the counter 1 is supplied with a reference clock and a horizontal synchronizing signal and counts the number of reference clocks lying for an interval during which the next horizontal synchronizing signal is inputted after the horizontal synchronizing signal has been inputted. Thereafter, the counter 1 outputs the result of counting (which is represented as CNT in FIG. 1) to the copy pulse generating circuit 7 whenever necessary. When the CNT has coincided with a constant value, the copy pulse generating circuit 7 outputs pulses therefrom, i.e., the copy pulse generating circuit 7 is set so as to output pulses every predetermined intervals. As shown in FIG. 2, the copy pulse generating circuit 7 generates an original clock pulse signal (which is represented as CLK in FIG. 1) having pulses which rise with two timings: the timing provided to rise the horizontal synchronizing signal and the timing provided at one-third time obtained by dividing one horizontal period into three equal parts. Further, the copy pulse generating circuit 7 generates a copying second clock pulse signal (hereinafter called simply "copying clock pulse signal" and represented as CLK-2 in FIG. 1) having pulses each of which rises with timing provided at two-third time obtained by dividing one horizontal period into three equal parts as distinct from the original clock pulse signal.

Next, the original clock pulse signal CLK and copying clock pulse signal CLK-2 outputted from the copy pulse generating circuit 7 are inputted to the OE·gate clock generating circuit 9, from which an OE signal is generated. One function of the OE signal is provided to control whether the copying clock pulse signal CLK-2 should be superimposed on the original clock pulse signal CLK for a given horizontal period upon generation of a gate clock signal to be described later. Thus, the OE·gate clock generating circuit 9 generates the gate clock signal (which is represented as G-CLK in FIG. 1) having pulses obtained by superimposing all the pulses of the original clock pulse signal CLK on pulses corresponding to the number obtained by subtracting the number of the vertical pixels of the video signal from the number of the vertical pixels of the display unit 6 in the copying clock pulse signal CLK-2. Since, at this time, the OE signal serves so that the inverse of a pulse waveform of the OE signal and each pulse of the copying clock pulse signal CLK-2 overlap each other as shown in FIG. 2, the pulses of the copying clock pulse signal CLK-2 do not overlap with ones in the gate clock signal G-CLK at points where the pulses of the OE signal exist, and the pulses of the copying clock pulse signal CLK-2 overlap at points where the pulses of the OE signal do not exist.

Next, the gate clock signal G-CLK and the OE signal outputted from the OE·gate clock generating circuit 9 are inputted to the gate driver 5 through the selector switch 11. The gate driver 5 generates a plurality of gate driving signals (which are represented as G1, G2, . . . in FIG. 1) having such waveforms that they rise to high levels in response to timings provided on the rising edges of the pulses in the gate clock signal G-CLK and they fall to low levels with timings provided on the falling edges of the next pulses, and outputs the gate driving signals to the display unit 6. Another function of the OE signal is as follows: After the gate driving signal G2 in FIG. 2 has risen to a high level at the second pulse of the gate clock signal, the gate driving signal G2 falls to a low level according to the rising edge of the OE signal. Thereafter, a plurality of gate lines of the display unit 6 are respectively driven according to the plurality of driving signals G1, G2, . . . At this time, a START signal is brought to a high level and the output of the gate driving signal G1 is started from timing provided on the rising edge of the initial pulse of the gate clock signal. Namely, the START signal is a signal for determining the timing provided to output the initial line (corresponding to the top horizontal line of TFT-LCD display unit 6).

A case where the number of vertical pixels of a video signal is greater than the number of the vertical pixels of the display unit 6 and the thinning (reduction display) is done, will next be explained below with reference to FIG. 3 by way of example.

The operation of the counter 1 is common with the case where the copy is done. The counter 1 counts the number of reference clocks lying for an interval during which the next horizontal synchronizing signal is inputted as viewed from one horizontal synchronizing signal. Thereafter, the counter 1 outputs the result of counting CNT to the thinning pulse generating circuit 8 whenever necessary. When the CNT has coincided with a given constant value, the thinning pulse generating circuit 8 is set so as to output pulses. As shown in FIG. 3, the thinning pulse generating circuit 8 generates an original clock pulse signal (which is represented as CLK' in FIG. 1) having pulses which rise with two timings: the timing provided to rise the horizontal synchronizing signal and the timing provided at one-second time obtained by dividing one horizontal period into two equal parts. The original clock pulse signal CLK' is the original clock pulse signal for a double-speed line sequential driving system. Simultaneously, the thinning pulse generating circuit 8 generates a thinning second clock pulse signal (hereinafter called simply "thinning clock pulse signal" and represented as CLK'-2 in FIG. 1) having pulses each of which is used to determine with which timing the pulses in the original clock pulse signal CLK' should be thinned out.

Next, the OE·gate clock generating circuit 10 receives therein the original clock pulse signal CLK' and the thinning clock pulse signal CLK'-2 from the thinning pulse generating circuit 8 to thereby generate an OE signal (which is represented as OE' in FIG. 1) synchronized with the timing provided on the rising edge of the pulse of the thinning clock pulse signal CLK'-2. The OE·gate clock generating circuit 10 generates a gate clock signal (which is represented as G-CLK' in FIG. 1) having pulses obtained by superimposing all the pulses in the original clock pulse signal CLK' on the pulses of the thinning clock pulse signal CLK'-2. However, the superimposition of the pulses on the other pulses means that an inverter is connected to or provided for the output of the thinning clock pulse signal CLK'-2 so as to take "NOT" and take "AND" of the result thereof and the original clock pulse signal. Further, the gate clock signal G-CLK' is maintained at a low level during a period in which the OE signal synchronized with the rise timing of each of the thinning clock pulse signal CLK'-2. Thus, the pulses of the original clock pulse signal CLK' are thinned out at points where the pulses of the thinning clock pulse signal CLK'-2 exist. The pulses of the original clock pulse signal CLK' remain in the gate clock signal G-CLK' as they are at points where the pulses of the thinning clock pulse signal CLK'-2 do not exist.

Further, the action of the gate driver 5 is similar to the case in which the copy is done. When the gate clock signal G-CLK' and the OE signal outputted from the OE·gate clock generating circuit 10 are inputted to the gate driver 5, the gate driver 5 generates a plurality of gate driving signals (which are represented as G1, G2, . . . in FIG. 1) having such waveforms that they rise to high levels in synchronism with to rise timings of the pulses in the gate clock signal G-CLK' and they fall to low levels with fall timings of the next pulses. Thereafter, the gate driver 5 outputs them to the display unit 6. After the gate driving signal G1 in FIG. 3 has risen to a high level at the first pulse of the gate clock signal, the gate driving signal G1 falls to a low level according to the rising edge of the OE signal. Afterwards, the respective gate lines of the display unit 6 are respectively driven according to the plurality of gate driving signals G1, G2, . . .

In the liquid crystal display device according to the present embodiment, the driving circuit is capable of coping with either of the enlargement display and the reduction display. In the case of the enlargement display, the two or three gate lines are driven within one horizontal period and the same video data corresponding to one line is displayed on the plurality of lines lying over the display unit 6, as shown in FIG. 2. Therefore, the enlargement display corresponding to the number of the vertical pixels of the display unit 6 is performed. In the case of the reduction display, some of the original clock pulse signal having the pulses provided two by two within one horizontal period originally used in the double-speed line sequential driving system are thinned out, so that the reduction display corresponding to the number of the vertical pixels of the display unit 6 is easily carried out.

In the present embodiment as described above, when the enlargement display or the reduction display is performed, the respective gate driving signals G1, G2, . . . for respectively driving the plurality of gate lines are respectively brought to the high levels with the different timings. Since the adjacent two gate lines are not brought to the high level simultaneously as in the case of the conventional enlargement display method, the present embodiment can be applied to the liquid crystal display device with auxiliary capacitances each having a Cs on-gate structure without any problem. Further, since the plurality of gate driving signals respectively have the high level periods equal in length to each other, no variations in image occur in the display unit 6.

An image uniform in quality can be obtained over the entire screen of the display unit 6 by uniformly allocating the timings provided to superimpose the copying clock pulse signal CLK-2 or OE signal on the gate clock signals G-CLK and G-CLK' over the number of the vertical pixels of the display unit 6.

Incidentally, the technical scope of the present invention is not limited to the above-described embodiment. Various changes can be made thereto within the scope not departing from the substance of the present invention. For example, the aforementioned embodiment has described the example of the liquid crystal display device which combines both the enlargement display and reduction display with each other. However, if the liquid crystal display device is satisfied by only one function, then a circuit configuration corresponding thereto may be taken. Further, the present invention can be applied to a TFT type liquid crystal display device and a liquid crystal display device using a ferroelectric liquid crystal or anti-ferroelectric liquid crystal.

According to the display device of the present invention, as has been described above in detail, when an enlargement display or reduction display is performed, a plurality of gate driving signals for driving a plurality of gate lines are respectively rendered high in level with different timings. Further, adjacent two gate lines are not brought to a high level simultaneously as in the case of a conventional enlargement display method. It is therefore possible to apply the invention to the display device with auxiliary capacitances each having a Cs on-gate structure without any problem. Further, since the plurality of gate driving signals respectively have high level periods equal in length to each other, a display device can be obtained which no produces variations in image in a display unit and is excellent in uniformity of image quality.

What is claimed is:

1. A display device, comprising:

a driving circuit including, pulse generating means for generating a copying second clock pulse signal within one horizontal period in addition to an original clock pulse signal generated upon provision of the number of vertical pixels identical to a predetermined number of vertical pixels of a display unit when a video signal having the number of vertical pixels smaller than the predetermined number of vertical pixels is displayed in enlarged form on the display unit to which the predetermined number of vertical pixels is set and repeating the generation of these clock pulse signals every one horizontal periods;

gate clock generating means for receiving the clock pulse signal from said pulse generating means to thereby generate a gate clock signal obtained by superimposing the total original clock pulse signal and the second clock pulse signal corresponding to a number obtained by subtracting the number of the vertical pixels of the video signal from the number of the vertical pixels of the display unit; and gate driving means for receiving the gate clock signal from said gate clock generating means to thereby generate a plurality of gate driving signals which are respectively brought to high levels with different timings in association with respective pulses in the gate clock signal and have high level periods equal in length to one another.

2. The display device according to claim 1, wherein said gate clock generating means uniformly allocates timings provided to superimpose the second clock pulse signal on the gate clock signal over the number of the vertical pixels of the display unit.

3. The display device according to claim 1, wherein said display device is a TFT type liquid crystal display device, and storage capacitances each comprised of a gate line and a pixel electrode corresponding to said each pixel are provided for the respective pixels of the display unit of the TFT type liquid crystal display device.

4. A display device, comprising:

a driving circuit including, pulse generating means for generating a thinning second clock pulse signal within one horizontal period, said second clock pulse signal being identical in pulse width to an original clock pulse signal generated upon provision of the number of vertical pixels identical to a predetermined number of vertical pixels of a display unit, in addition to the original clock pulse signal when a video signal having the number of vertical pixels greater than the predetermined number of vertical pixels is displayed in reduced form on the display unit to which the predetermined number of vertical pixels is set and repeating the generation of these clock pulse signals every one horizontal periods;

gate clock generating means for receiving the clock pulse signal from said pulse generating means to thereby generate a gate clock signal obtained by superimposing the total original clock pulse signal and the second clock pulse signal corresponding to a number obtained by subtracting the number of the vertical pixels of the display unit from the number of the vertical pixels of the video signal; and gate driving means for receiving the gate clock signal from said gate clock generating means to thereby generate a plurality of gate driving signals which are respectively brought to high levels with different timings in association with respective pulses in the gate clock signal and have high level periods equal in length to one another.

5. The display device according to claim 4, wherein said gate clock generating means uniformly allocates timings provided to superimpose the second clock pulse signal on the gate clock signal over the number of the vertical pixels of the display unit.

6. The display device according to claim 4, wherein said display device is a TFT type liquid crystal display device, and storage capacitances each comprised of a gate line and a pixel electrode corresponding to said each pixel are provided for the respective pixels of the display unit of the TFT type liquid crystal display device.

* * * * *